US011408253B1

(12) United States Patent
Deng et al.

(10) Patent No.: US 11,408,253 B1
(45) Date of Patent: Aug. 9, 2022

(54) YIELDABLE LANDING FEATURE

(71) Applicants: Guijun Deng, The Woodlands, TX (US); Nils Neumann, Spring, TX (US); Matthew Krueger, Cypress, TX (US); Joshua Snitkoff, Houston, TX (US)

(72) Inventors: Guijun Deng, The Woodlands, TX (US); Nils Neumann, Spring, TX (US); Matthew Krueger, Cypress, TX (US); Joshua Snitkoff, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/224,319

(22) Filed: Apr. 7, 2021

(51) Int. Cl.
*E21B 34/14* (2006.01)
*E21B 40/00* (2006.01)

(52) U.S. Cl.
CPC ..... *E21B 40/001* (2020.05)

(58) Field of Classification Search
CPC ..... E21B 34/14; E21B 2200/06; E21B 34/063
See application file for complete search history.

(56) References Cited

U.S. PATENT DOCUMENTS 5,146,992 A * 9/1992 Baugh ..... E21B 23/08 166/154
5,960,881 A * 10/1999 Allamon ..... E21B 21/103 166/285
2001/0045288 A1* 11/2001 Allamon ..... E21B 23/04 166/373
2002/0162661 A1* 11/2002 Krauss ..... E21B 34/108 166/318
2014/0262324 A1* 9/2014 Greci ..... E21B 34/10 166/374
2017/0122441 A1* 5/2017 Adam ..... F16K 1/14
2019/0072187 A1* 3/2019 Park ..... E21B 34/10

* cited by examiner

*Primary Examiner* — Kipp C Wallace
(74) *Attorney, Agent, or Firm* — Cantor Colburn LLP

(57) ABSTRACT

Yieldable object landing feature including a first object landing region configured to receive and support a first size object, a second object landing region configured to receive and support a second size object, and a stress riser disposed to initiate crack formation in the second object landing region.

20 Claims, 3 Drawing Sheets

YIELDABLE LANDING FEATURE

BACKGROUND

In the resource recovery and fluid sequestration industry, there is often need for dropping objects on landing features to cause wellbore actions. In some of these cases, ore than one object might be dropped and might be of varying size. Sometimes a second size larger object is landed on a landing feature and will still require forcing through that feature. Where a feature is configured for a smaller first object first, the larger object employed second may require a very large force to move it though the landing feature after its second object's primary function has been achieved.

SUMMARY

An embodiment of a yieldable object landing feature including a first object landing region configured to receive and support a first size object, a second object landing region configured to receive and support a second size object, and a stress riser disposed to initiate crack formation in the second object landing region.

An embodiment of a method of operating a wellbore including advancing a first size object to a landing feature, landing the first size object in a first object landing region of the landing feature, pressuring against the first size object to cause a wellbore action, raising pressure against the first size object to force the first size object through the first object landing region of the landing feature, advancing a second size object to the landing feature, landing the second size object in a second object landing region of the landing feature, pressuring against the second size object to cause another wellbore action, raising pressure against the second size object, fracturing the second object landing region, and forcing the second size object through the second object landing region of the landing feature at a pressure no greater than the pressure associated with forcing the first size object through the first object landing region of the landing feature.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
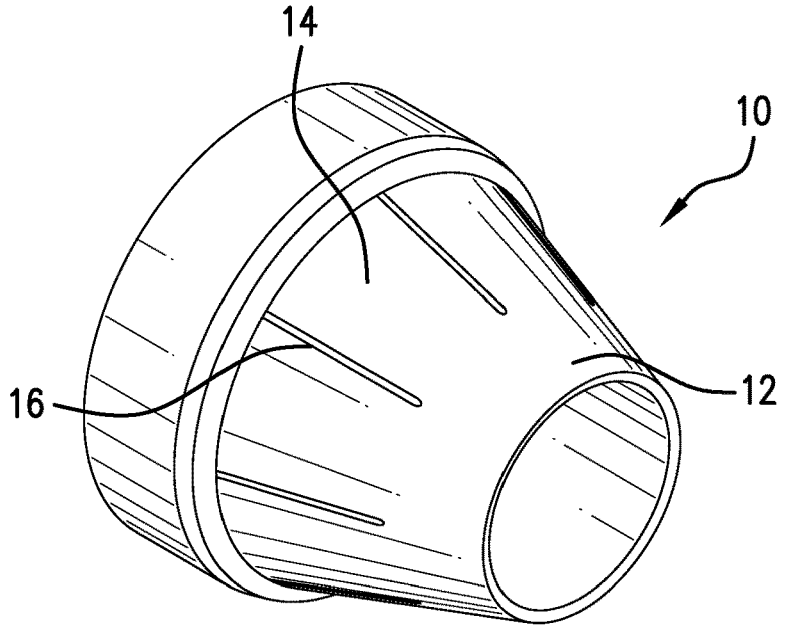
FIG. 1 is a perspective view of a first embodiment of a yieldable object landing feature as disclosed herein in a first condition.
Figure 2:
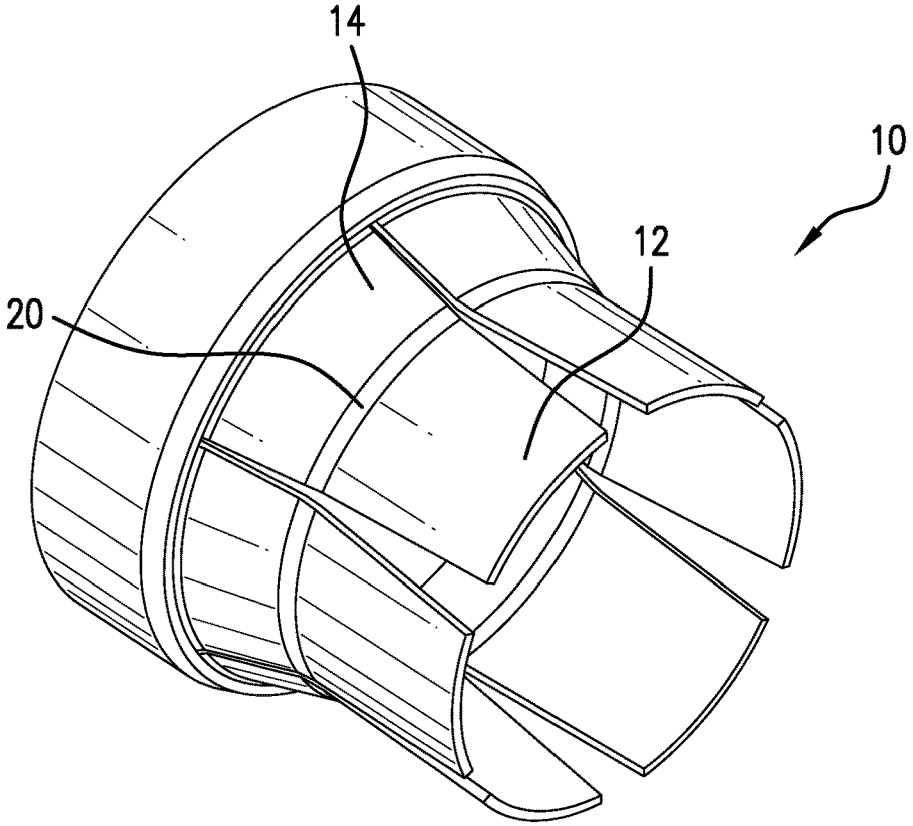
FIG. 2 is a perspective view of the first embodiment of the yieldable object landing feature as disclosed herein in a second condition.

Referring to FIG. 1 a first embodiment of a yieldable object landing feature 10 is illustrated in a first condition. The first condition is a run-in condition of the feature 10. The feature 10 may be a part of a fracturing system or any other downhole system where the use of an object disposed in a landing feature is required to initiate a wellbore action, for example a pressure up event to cause a shifting of a sleeve, setting of a packer, initiation of another tool, fracture initiation, etc. The feature 10 is usable in a single object application if desired and will function normally in such use. Feature 10 also however is usable in a two or more object application. This is due to the construction of the landing feature 10. Specifically, the landing feature 10 includes a first object landing region 12 and a second object landing region 14. The first object landing region 12 is geometrically smaller than the region 14. In embodiments, the geometric difference is simply a function of a frustoconial shape of the feature 10. The first object landing region 12 is configured to land and support a first object (not shown but could be a ball, a dart, a plug, etc.). The first object may be used to facilitate a differential pressure across the joined first object and the landing feature 10. This differential pressure may be used for any well function such as shifting a sleeve, fracturing the formation, etc. Once the function is completed, the first object may be cleared from the landing feature 10 by overpressure, which will cause the object to move through the feature 10. This may be by extrusion of the object alone of may include sone deformation of the first object landing region. The first object landing region 12 does not however crack. In a subsequent operation, it might become desirable to land a second size object (not shown but could be a ball, a dart, a plug, etc.) on the second object landing region 14. This second object may also be used for any well function such as shifting a sleeve, fracturing the formation, etc. Since the second size object is larger than the first size object, the second object landing region 14 is larger than the first object landing region 12 and accordingly naturally possesses greater resistance to passing the second size object in landing features of the prior art. The feature 10 disclosed herein however, solves that impediment to use by including a stress riser 16 in the second object landing region 14 of the landing feature 10. The stress riser may be an indentation, a groove, combinations of such features or combinations including at least one of the foregoing. The stress riser should remain fluid tight however prior to initiation of crack formation. In an embodiment shown in FIGS. 1 and 2 in the first and second conditions, respectively, the second object landing region can be seen intact (FIG. 1) and cracked (FIG. 2). Axiomatically, the cracking of region 14 along stress riser 16 will result in the cracking of region 12 upon second object passage. Due to the cracking, the required overpressure to drive the second object through the second object landing region 14 is no greater than the overpressure needed to drive the first object through the first object landing region 12.

Figure 3:
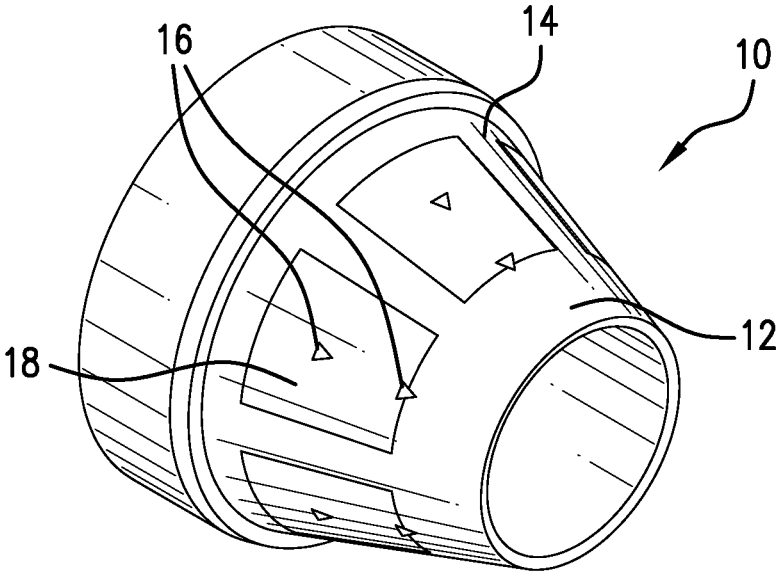
FIG. 3 is a perspective view of a second embodiment of a yieldable object landing feature as disclosed herein in a first condition.
Figure 4:
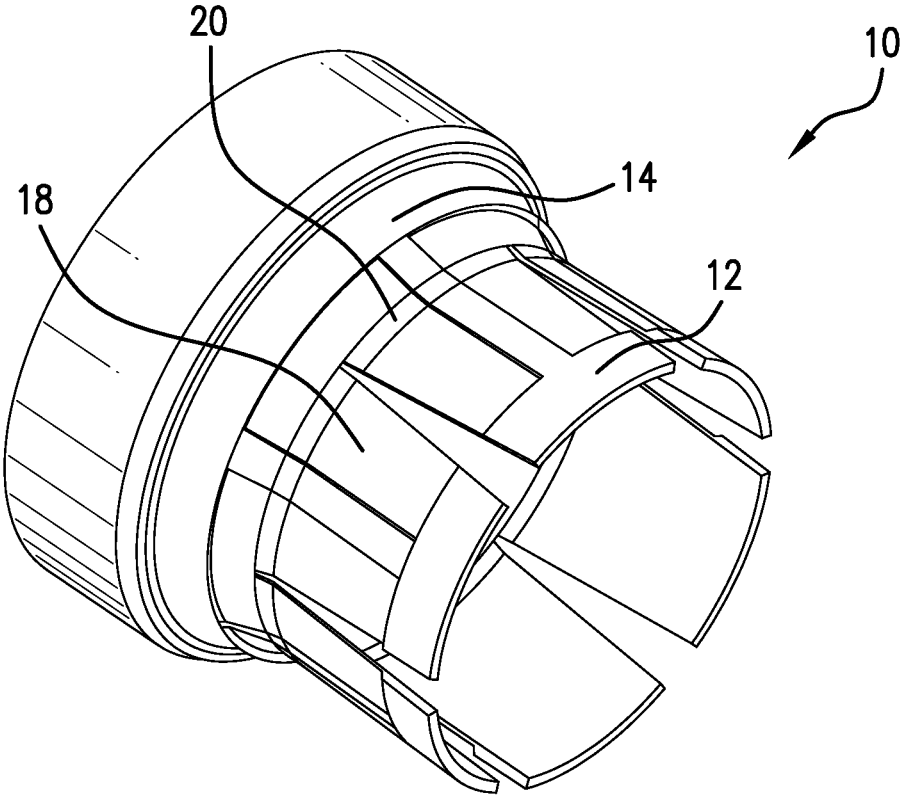
FIG. 4 is a perspective view of the second embodiment of the yieldable object landing feature as disclosed herein in a second condition.

In another embodiment, referring to FIGS. 3 and 4, a reduced bending resistance portion 18 is also introduced to the second object landing region. The reduced bending resistance portion 18 may be a thinner area of material of the feature 10 than other areas of the same region, or may be a differing material than other portions of the region or may be the same material but having differing properties in the portion 18 relative to other portions of the region 12 or 14. It is to be appreciated that such a change in material property of the same material is easily obtainable in an additive manufacturing process but may also be achieved through more traditional thermal processes. The portion 18 aids in control of the force required to pass the second size object by making the cracked material bend more easily. The portion 18 may be discrete, may be a number of portions 18 like that shown in FIGS. 3 an 4, or may be annular in shape about the feature 10. An annular portion 20 is also illustrated in FIGS. 2 and 4. One or more of the portions 18 and/or 20 may be employed in any embodiments hereof.

The feature 10 described herein is well suited to use in a wellbore for a staged fracture operation where multiple objects are dropped having varying sizes and that have differing functions. The feature 10 facilitates differing functions without the need for significantly different overpressures and avoids the high overpressures sometimes necessary in the prior art that could damage equipment.

Figure 5:
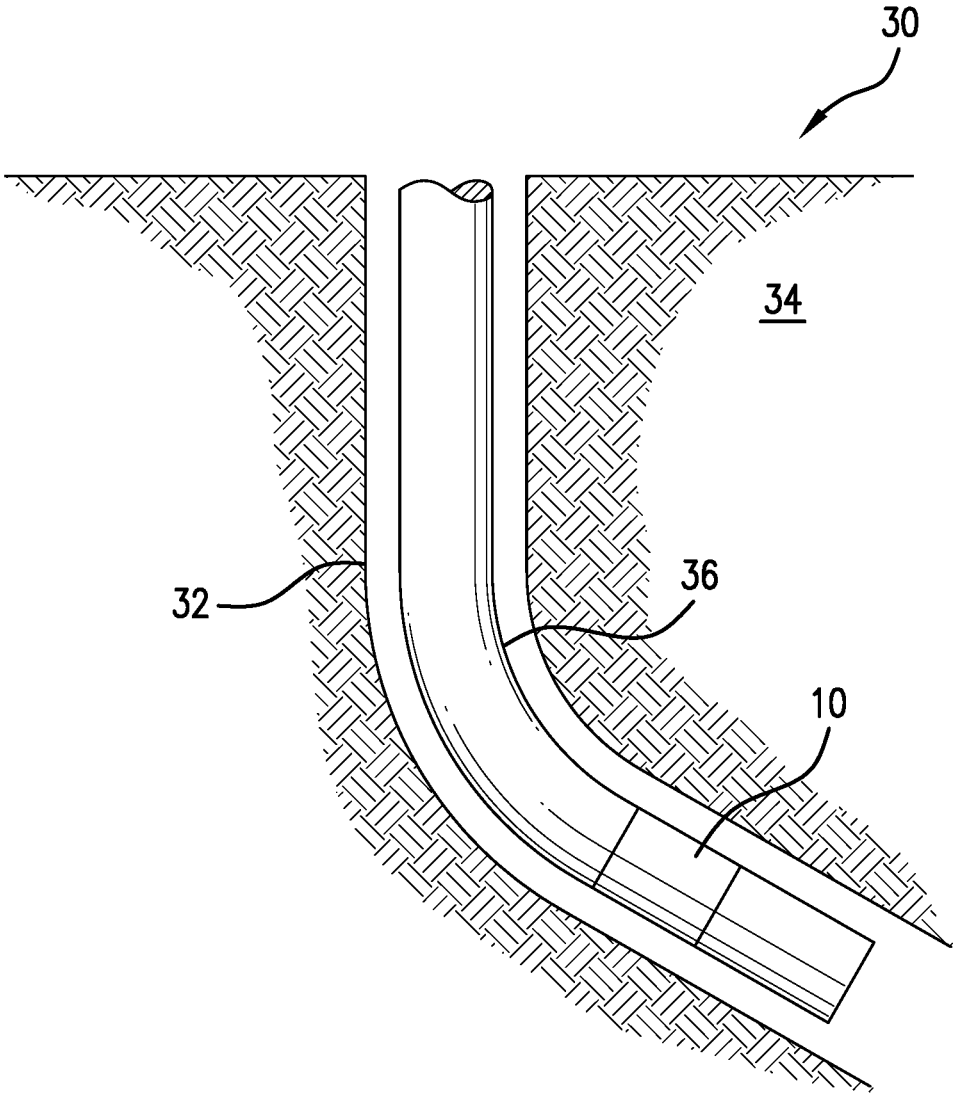
FIG. 5 is a schematic representation of a wellbore system including the yieldable object landing feature as disclosed herein.

Referring to FIG. 5, a wellbore system 30 is illustrated. The system 30 includes a borehole 32 in a subsurface formation 34. A string 36 is disposed in the borehole 32. The string includes a yieldable object landing feature 10 and may include a plurality of features 10. The single schematic indication of feature 10 is intended to illustrate one of more features 10. The features 10 may be a part of a staged fracture system.

Set forth below are some embodiments of the foregoing disclosure:

Embodiment 1: Yieldable object landing feature including a first object landing region configured to receive and support a first size object, a second object landing region configured to receive and support a second size object, and a stress riser disposed to initiate crack formation in the second object landing region.

Embodiment 2: The yieldable object landing feature as in any prior embodiment, wherein the stress riser initiates a crack upon application of pressure to the second size object when supported in the second object landing region.

Embodiment 3: The yieldable object landing feature as in any prior embodiment, wherein the first object landing area is of a frustoconical shape and configured to hold a selected pressure differential thereacross when the first size object is supported therein.

Embodiment 4: The yieldable object landing feature as in any prior embodiment, wherein the first object landing area when yielded to pass the first size object is fractureless.

Embodiment 5: The yieldable object landing feature as in any prior embodiment, wherein the stress riser is configured to initiate crack formation as a selected pressure differential across the second object landing region and a second size object supported therein reaches a selected threshold level.

Embodiment 6: The yieldable object landing feature as in any prior embodiment, wherein the stress riser is a groove in a material of the second object landing region.

Embodiment 7: The yieldable object landing feature as in any prior embodiment, wherein the groove is longitudinally oriented relative to the yieldable object landing feature.

Embodiment 8: The yieldable object landing feature as in any prior embodiment, wherein the groove extends a longitudinal length of the second object landing region.

Embodiment 9: The yieldable object landing feature as in any prior embodiment, wherein the stress riser is an indentation in a material of the second object landing region.

Embodiment 10: The yieldable object landing feature as in any prior embodiment, the second object landing region further comprising a reduced bending resistance portion thereof having a reduced bending resistance relative to a balance of the second object landing region.

Embodiment 11: The yieldable object landing feature as in any prior embodiment, wherein the reduced bending resistance portion is a thinner material than a thickness of material of the balance of the second object landing region.

Embodiment 12: The yieldable object landing feature as in any prior embodiment, wherein the reduced bending resistance portion is a different material than a material of the balance of the second object landing region.

Embodiment 13: The yieldable object landing feature as in any prior embodiment, wherein the reduced bending resistance portion is a different material property than a material of the balance of the second object landing region.

Embodiment 14: The yieldable object landing feature as in any prior embodiment, wherein a yield strength of the first object landing region is greater than or equal to a yield strength of the second object landing region.

Embodiment 15: A method of operating a wellbore including advancing a first size object to a landing feature, landing the first size object in a first object landing region of the landing feature, pressuring against the first size object to cause a wellbore action, raising pressure against the first size object to force the first size object through the first object landing region of the landing feature, advancing a second size object to the landing feature, landing the second size object in a second object landing region of the landing feature, pressuring against the second size object to cause another wellbore action, raising pressure against the second size object, fracturing the second object landing region, and forcing the second size object through the second object landing region of the landing feature at a pressure no greater than the pressure associated with forcing the first size object through the first object landing region of the landing feature.

Embodiment 16: The method as in any prior embodiment, further including bending portions of the second object landing region.

Embodiment 17: The method as in any prior embodiment, wherein the bending is at reduced bending resistance portions of the second object landing region relative to other portions of the second object landing region.

Embodiment 18: The method as in any prior embodiment, further including initiating fractures in the second object landing region.

Embodiment 19: A wellbore system including a borehole in a subsurface formation, a string disposed in the borehole, a yieldable object landing feature as in any prior embodiment disposed with the string.

Embodiment 20: The system as in any prior embodiment, wherein a yield strength of the first object landing region is greater than or equal to a yield strength of the second object landing region.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A yieldable object landing feature comprising:

a first object landing region configured to receive and support a first size object;

a second object landing region on the same feature configured to receive and support a second size object; and a stress riser disposed in the second object landing region to initiate crack formation in the second object landing region, such that the second object landing region yields to allow passage of the second size object at a pressure no greater than the first object landing region yields to allow passage of the first size object, the first object landing region being devoid of any predetermined stress riser.

2. The yieldable object landing feature as claimed in claim 1 wherein the stress riser initiates a crack upon application of pressure to the second size object when supported in the second object landing region.

3. The yieldable object landing feature as claimed in claim 1 wherein the first object landing area is of a frustoconical shape and configured to hold a selected pressure differential thereacross when the first size object is supported therein.

4. The yieldable object landing feature as claimed in claim 1 wherein the first object landing area when yielded to pass the first size object is fractureless.

5. The yieldable object landing feature as claimed in claim 1 wherein the stress riser is configured to initiate crack formation as a selected pressure differential across the second object landing region and a second size object supported therein reaches a selected threshold level.

6. The yieldable object landing feature as claimed in claim 1 wherein the stress riser is a groove in a material of the second object landing region.

7. The yieldable object landing feature as claimed in claim 6 wherein the groove is longitudinally oriented relative to the yieldable object landing feature.

8. The yieldable object landing feature as claimed in claim 7 wherein the groove extends a longitudinal length of the second object landing region.

9. The yieldable object landing feature as claimed in claim 1 wherein the stress riser is an indentation in a material of the second object landing region.

10. The yieldable object landing feature as claimed in claim 1, the second object landing region further comprising a reduced bending resistance portion thereof having a reduced bending resistance relative to a balance of the second object landing region.

11. The yieldable object landing feature as claimed in claim 10 wherein the reduced bending resistance portion is a thinner material than a thickness of material of the balance of the second object landing region.

12. The yieldable object landing feature as claimed in claim 10 wherein the reduced bending resistance portion is a different material than a material of the balance of the second object landing region.

13. The yieldable object landing feature as claimed in claim 10 wherein the reduced bending resistance portion is a different material property than a material of the balance of the second object landing region.

14. The yieldable object landing feature as claimed in claim 1, wherein a yield strength of the first object landing region is greater than or equal to a yield strength of the second object landing region.

15. A wellbore system comprising:

a borehole in a subsurface formation;

a string disposed in the borehole;

a yieldable object landing feature as claimed in claim 1 disposed with the string.

16. The system as claimed in claim 15, wherein a yield strength of the first object landing region is greater than or equal to a yield strength of the second object landing region.

17. A method of operating a wellbore comprising:

advancing a first size object to a landing feature;

landing the first size object in a first object landing region of the landing feature;

pressuring against the first size object to cause a wellbore action;

raising pressure against the first size object to force the first size object through the first object landing region of the landing feature;

advancing a second size object to the landing feature;

landing the second size object in a second object landing region of the landing feature, a stress riser disposed in the second object landing region to initiate crack formation in the second object landing region, there being no predetermined stress riser in the first object landing region;

pressuring against the second size object to cause another wellbore action;

raising pressure against the second size object;

fracturing the second object landing region; and initiating crack formation at the stress riser, thereby forcing the second size object through the second object landing region of the landing feature at a pressure no greater than a pressure associated with forcing the first size object through the first object landing region of the landing feature.

18. The method as claimed in claim 17 further including bending portions of the second object landing region.

19. The method as claimed in claim 18 wherein the bending is at reduced bending resistance portions of the second object landing region relative to other portions of the second object landing region.

20. The method as claimed in claim 17 further including initiating fractures in the second object landing region.

* * * * *